United States Patent [19]

Milstead et al.

[11] Patent Number: 4,704,967

[45] Date of Patent: Nov. 10, 1987

[54] METHOD OF ASSEMBLY OF COMPACTED PARTICULATES AND EXPLOSIVE CHARGE

[75] Inventors: Leon R. Milstead, Timonium; Laban R. Lowe, White Hall; Robert W. Schnepfe, Jr., Upperso; Merlin L. Erickson, Perryman, all of Md.

[73] Assignee: AAI Corporation, Cockeysville, Md.

[21] Appl. No.: 863,762

[22] Filed: May 16, 1986

[51] Int. Cl.[4] ..... C06D 3/00

[52] U.S. Cl. ..... 102/334; 102/505; 264/3.6

[58] Field of Search ..... 102/334, 505, 367; 264/3.6

[56] References Cited

U.S. PATENT DOCUMENTS

| | | | |
|---|---|---|---|
| 3,860,199 | 1/1975 | Dunne | 102/513 X |
| 3,862,865 | 1/1975 | McManus et al. | 102/358 X |
| 3,898,661 | 8/1975 | Kelly et al. | 102/505 X |
| 3,899,975 | 8/1975 | Lawrence | 102/505 X |
| 4,135,455 | 1/1979 | Wallace | 102/505 X |
| 4,406,227 | 9/1983 | Beeker et al. | 102/505 X |
| 4,484,195 | 11/1984 | Shaffer | 102/334 X |

*Primary Examiner*—Peter A. Nelson

*Attorney, Agent, or Firm*—Reginald F. Pippin, Jr.

[57] ABSTRACT

A visual-and-infrared-screening cloud-forming product is made by forming a slurry of fine metal flakes of copper composition, particularly brass, of submicron thickness and multimicron lateral face dimensions, together with a volatile surface-wetting agent liquid, in the form of a liquid hydrocarbon, extruding and severing the extended slurry mass into small segments, drying the small segments, placing the small segments into a desired container shape and crushing such segments in place and into such shape, in particular in a hollow cylindrical shape. An HE explosive mass is inserted into the resulting compacted hollow cylinder, enabling bursting of the compacted mass.

13 Claims, 10 Drawing Figures

METHOD OF ASSEMBLY OF COMPACTED PARTICULATES AND EXPLOSIVE CHARGE

The U.S. Government has a paid-up license in this invention and the right in limited circumstances to require the patent owner to license others on reasonable terms as provided for by the terms of Contract Number DAAK11-79-C-0123 awarded by Department of the Army.

This invention relates to a method of assembly of compacted particulates, particularly very fine metallic flakes which are normally very light and fluffy, together with an explosive charge for aerosoling the resulting compacted mass of metal flakes.

Efforts to develop a screening cloud that will protect military equipment from both visual and infrared detection have been underway for a number of years. Various military vehicles are conventionally equipped with smoke grenades and suitable launchers, such as launching tubes or barrels, singly or in clusters, whereby the grenades are launched to provide a visual screen relative to the vehicle.

It is an object of the invention to form a compact mass of fine metal flakes of copper composition for use in a volume-limited grenade to enable dissemination of the metal flakes as a visual and infrared screening cloud, in a manner compatible with current vehicle-mounted smoke grenade launcher systems. Screening effectiveness is optimized by providing an HE explosive central burster within the resultant densely compacted special metal flake composition of copper or copper alloys for a volume-limited device such as an infrared screening grenade.

Still other objects and attendant advantages will become apparent to those skilled in the art, from a reading of the following detailed description of an illustrative mode of practice of the invention, taken in conjunction with the accompanying Drawings, wherein.

Figure 1:
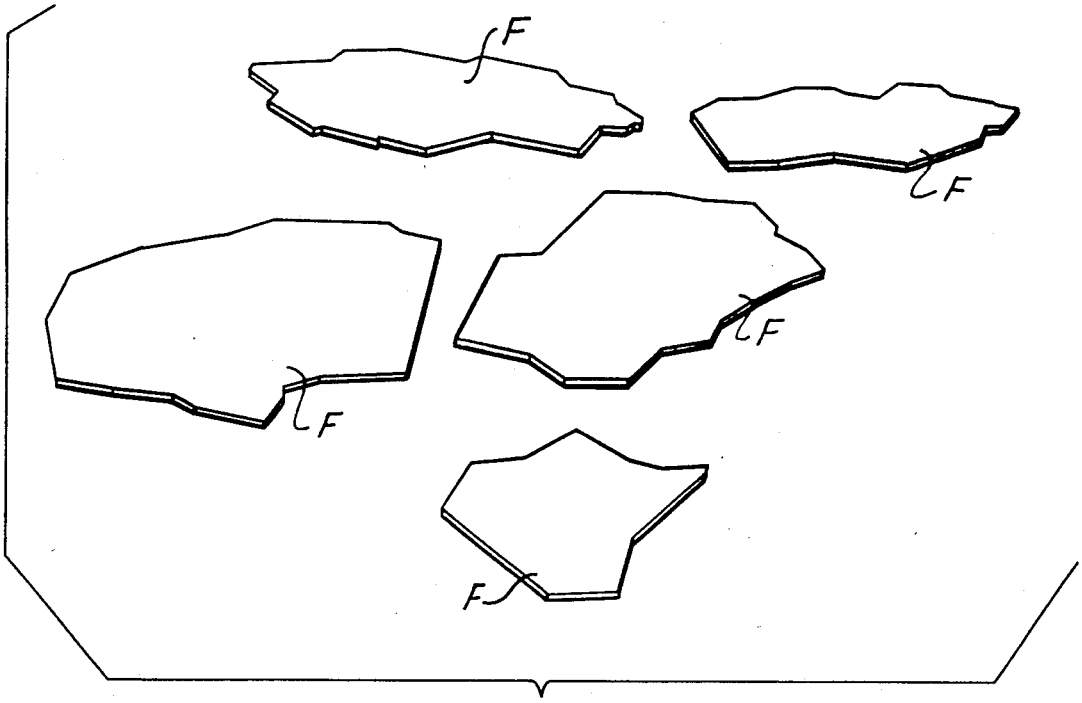
FIG. 1 is a general representation in perspective, of typical fine metal flake configurations employed in practicing the invention.
Figure 2:
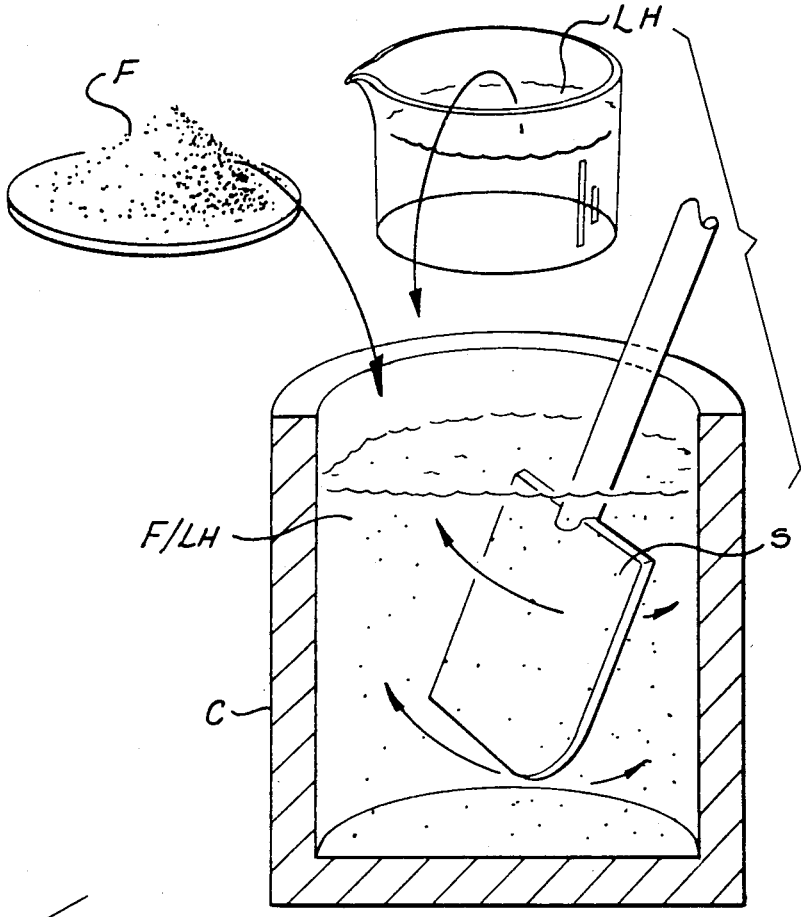
FIG. 2 illustrates mixing.
Figure 3:
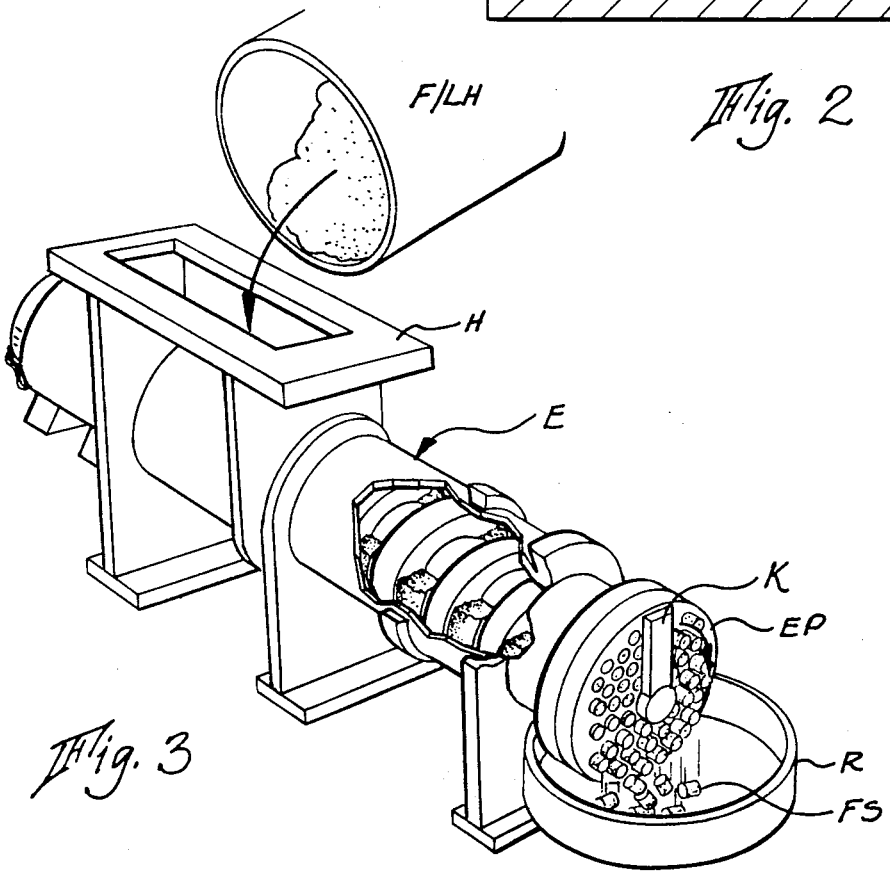
FIG. 3 illustrates extrusion and cutting into multiple small segments, of a mix of metal flakes and liquid.
Figure 8:
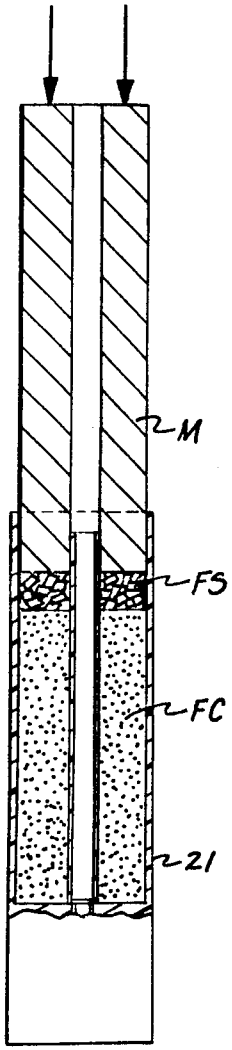
FIGS. 4–10 illustrate succeeding steps in compating of the metal flake particles in desired configuration and form.
Figure 7:
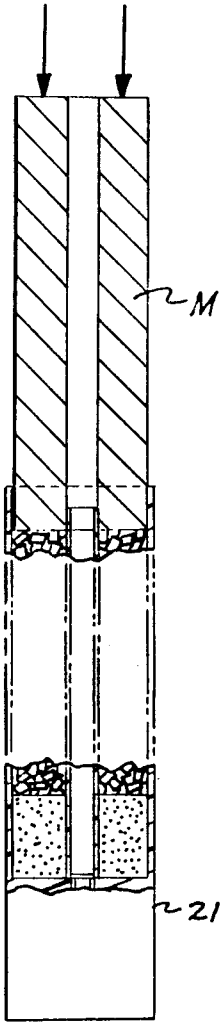
Figure 6:
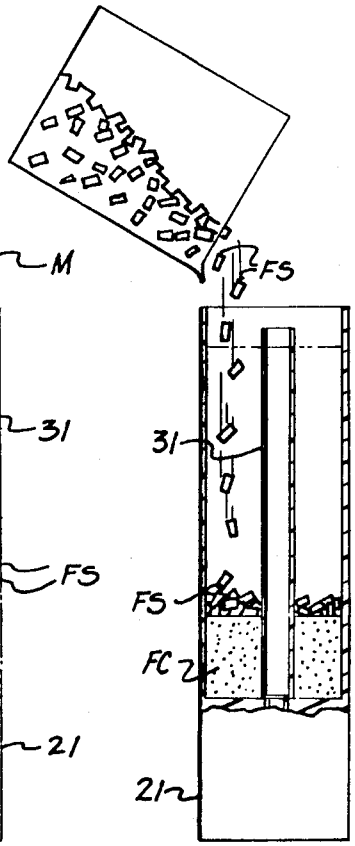
Figure 5:
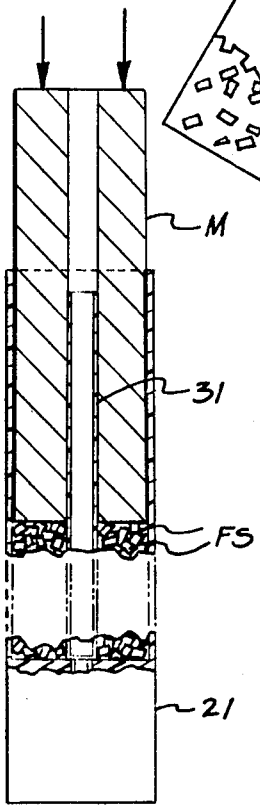
Figure 4:
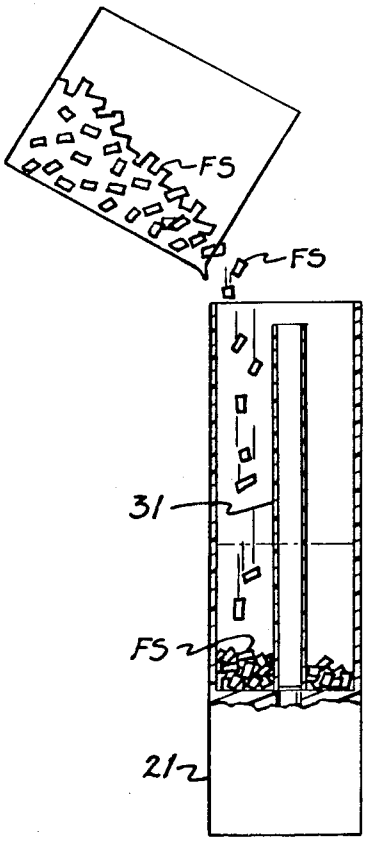

Referring now to the Figures of the Drawings, very fine metal flakes F of copper composition, particularly copper alloys and preferably brass, are suitably compacted by wetting and mxing with a suitable volatile wetting liquid in a container C, preferably a liquid hydrocarbon LH, such as trichloroethylene, tricloroethane, methylene chloride, etc., as shown in FIG. 2, in which a slurry mixture F/LH is formed by stirring the two mixed components of flakes F and liquid hydrocarbon LH, as with a stirrer S.

The slurry mixture F/LH is fed under ambient atmospheric pressure (which atmospheric pressure is not itself critical and may be any normally existing atmospheric pressure) into the hopper H of an extruder E, from which the compacted slurry is extruded through extruder die EP with the compacted wet extrusions exiting under the existing ambient atmospheric pressure, and being thereupon cut into small segments or pellets FS by a rotating scraper or knife K which may be accumulated in a receiver R.

The small compacted segments FS of self-adhered flakes F are then permitted to dry which may be suitably achieved by simple evaporative drying under a wide range of normal ambient room conditions of temperature and pressure such as, for example only, from 40°–90° F., and 28–30 inches mercury. The dried pellets of compacted self-adhered pellets are inserted by successive small quantity amounts into a desired body 21 having a tubular configuration formed by the addition of a central guide tube 31, to enable formation of a desired tubular or hollow cylindrical mass of compacted flakes F.

Figure 9:
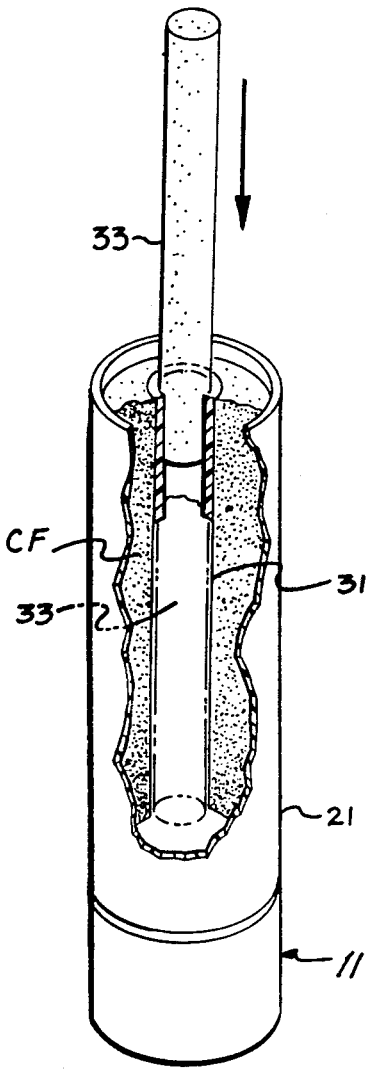

Each succeeding small portion of the compacted metal flake segments or pellets FS is crushed to a compacted mass FC by tamping with a hollow mandrel or tamping cylinder M which conforms to the configuration of the zone between the guide tube 31 and the side walls of body 21, with successive additions and crushing compaction of further small amounts of such compacted metal flake segments or pellets FS within the body 21, as shown in FIGS. 4–8, until the desired final volume of compacted fine metal flakes is reached as shown in FIG. 9, after which a cylindrical mass 33 of HE explosive is inserted within guide tube 31, and a cover 40 is suitably secured in the end of the body 21 over the entire assembly of the final compacted mass FC of fine flakes of copper or copper alloy and the HE explosive cylindrical mass 33. The repetitive additions and the tamping and compacting as shown in FIGS. 4–8 may generally be employed to reduce the volume of the flakes F in pellet or segment form FS by about thirty percent (30%), to thereby form a compact generally cohesive mass is nevertheless capable of being aerosoled by the HE explosive mass 33.

This entire assembly may suitably form a projectile or grenade having a closed base 11 with a tubular body 21 and a cover 40, which may be suitably projected into the atmosphere and caused to burst by detonating the HE explosive, as by suitable ignition and detonation means, not shown.

A visual and infrared screening cloud will thus be formed in the atmosphere at the desired location.

In carrying out the foregoing method, it is an important and integral part thereof to employ suitable metal flake compositions and configurations and sizes. To this end, copper compositions have been found compatible with the necessary HE explosive blast, which causes ignition of various otherwise suitable metals, such as aluminum. Particularly copper alloys, such as brass and bronze, and preferably brass, have been successfully employed with adequate aerosolizing and cloud retention time, such flakes being random in size and shape and being generally of a size of the order of approximately 1.5–14 microns in lateral face dimensions of length, width, diameter or the like, and of the order of approximately 0.07–0.25 microns in thickness.

Metal flakes F of copper composition, particularly copper alloys, and preferably brass, which are employed as pigments in the printing industry, have been found to be highly suitable for practice of this invention.

Figure 10:
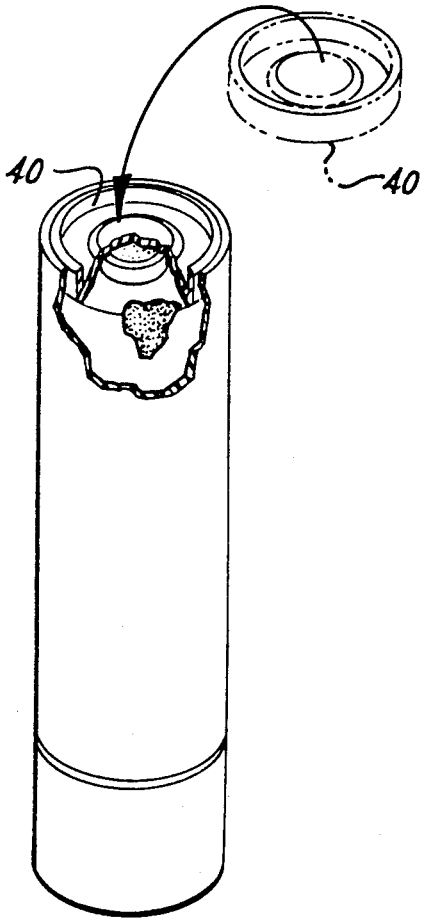

It has been found that a hollow cylindrical or tubular shape is a desirable configuration to enable both adequate bursting of the compact flake mass CF to aerosol the flakes F in the atmosphere, and also to enable its use in a suitably launchable cylindrical grenade form as shown in FIG. 10.

The term explosive is generally accepted as being a composition whose consumption rate is 20,000 feet per second or greater.

A ratio of the weight of the compacted mass of metal flakes CF relative to the HE explosive charge mass 31 may be employed within the general range of approximately 20:1 to 60:1, with an optimum ratio being approximately 40:1, particularly for brass flakes CF. This yields maximum visual and infrared screening attenuation over an adequate area to screen the source and the surrounding personnel or vehicles, consistent with grenade volume and shape constraints imposed by launching from a launch tube of desired conventional relatively small size.

A particular advantage of the copper flake composition, particularly copper alloys and preferably brass, for the compacted metal flakes CF, is the ability of these flakes to provide a highly effective visual and infrared screening cloud of adequately long retention, while not flashing or igniting as a result of the explosive bursting of the compact mass CF by the HE explosive 31.

While the invention has been illustrated and described with respect to a single illustrative embodiment, it will be appreciated that various modifications and improvements may be made without departing from the scope and spirit of the invention. Accordingly, the invention is not to be limited by the particular illustrative embodiment, but only by the scope of the appended claims.

We claim:

1. The method of forming a product which may be explosively burst apart to form a visual and infrared screening cloud, comprising:

forming a slurry mixture of fine metal flakes and a volatile liquid in which said flakes are of greater density than said liquid to thereby wet the flakes, thereby causing said flakes to adhere to one another in a randomly stacked and self-compacted form at the bottom of said slurry mixture, and enabling said volatile liquid to be removed from said mixture while maintaining said flakes in a nonaerosol compact adhered mass form, to thereby leave and form a compact mutually face-to-face adhered solid mass of said metal flakes.

2. The method according to claim 1, in which said metal flakes are of submicron thickness.

3. The method according to said submicron-thickness metal flakes comprising one of copper and copper alloys.

4. The method according to claim 2, said metallic flakes having a copper composition.

5. The method according to claim 4, said metallic flakes being a copper alloy.

6. The method according to claim 5, said metallic flakes being brass.

7. The method according to claim 6, said submicron-thickness brass flakes being generally of the order of approximately 1.5–14 microns in lateral face dimensions of length, width, diameter or the like and of the order of approximately 0.07–0.27 micron in thickness.

8. The method according to claim 2, in which said volatile liquid is a liquid hydrocarbon having good surfacewetting capability relative to said metallic flakes.

9. The method according to claim 2, and extruding said slurry mixture without change in ambient surrounding pressure on the slurry mixture prior to and after extrusion to form a compacted linear mass of metal flakes without decompressive dispersion.

10. The method of forming a product which may be explosively burst apart to form a visual and infrared screening cloud, comprising forming a slurry mixture of fine metal flakes and a volatile liquid in which said flakes are of greater density than said liquid to thereby wet the flakes, thereby causing said flakes to adhere to one another in a randomly stacked and self-compacted form at the bottom of said slurry mixture, enabling said volatile liquid to be removed from said mixture while maintaining said flakes in a nonaerosol closely adjacent condition, to thereby leave and form a compact mutually face-to-face adhered solid mass of said metal flakes, in which said metal flakes are of submicron thickness, extruding said mixture to form a compacted linear mass of metal flakes, and severing said extruded linear mass into small segments.

11. The method according to claim 10, further comprising:

drying said small segments, assembling said segments into a desired container, and crushing and compacting said segments to form a compact mass of said metal flakes in said container.

12. The method according to claim 11, assembling said segments into a frangible elongate container having a frangible central guide tube therein, with said segments being disposed within the space between said guide tube and the inner wall surface of said elongate container, said crushing and compacting being effected by effecting longitudinally directed force on said segments in a direction extending along the length of said space, whereby said mass is formed as a hollow cylindrical mass.

13. The method according to claim 12, and inserting an elongate HE explosive bursting charge within said guide tube along the length of said compact mass of metal flakes.

* * * * *